US009599367B1

(12) United States Patent
Curry

(10) Patent No.: US 9,599,367 B1
(45) Date of Patent: Mar. 21, 2017

(54) PORTABLE BATTERY OPERATED HEATER

(76) Inventor: Carline Curry, Mansfield, OH (US)

( * ) Notice: Subject to any disclaimer, the term of this patent is extended or adjusted under 35 U.S.C. 154(b) by 0 days.

(21) Appl. No.: 10/678,032

(22) Filed: Oct. 1, 2003

(51) Int. Cl.
*F24H 3/04* (2006.01)
*F24F 1/04* (2011.01)

(52) U.S. Cl.
CPC ..... *F24H 3/0417* (2013.01); *F24F 1/04* (2013.01)

(58) Field of Classification Search
CPC . F24C 3/14; F24H 1/06; F24H 3/0417; H05B 3/80; A45D 20/10; A45D 1/04; A45D 20/30
USPC ..... 237/16, 2 A, 2 R; 392/365, 384, 383; 219/386
See application file for complete search history.

(56) References Cited

U.S. PATENT DOCUMENTS 2,257,342 A * 9/1941 Lintern ..... F24H 3/0417 338/319
2,803,527 A * 8/1957 Lundahl ..... 415/182.1
2,982,949 A * 5/1961 Pivetz ..... 340/594
3,045,900 A * 7/1962 Zekendorf ..... 150/106
3,209,127 A * 9/1965 Graves ..... A47L 1/16 219/202
3,211,890 A * 10/1965 Graves ..... A47L 1/16 219/202
3,558,243 A * 1/1971 Trapp ..... 417/411
3,646,515 A * 2/1972 Vodehnal ..... 307/10.3
3,788,777 A * 1/1974 Fichter ..... 417/411
3,797,475 A * 3/1974 Hughes ..... A45D 20/06 126/206
4,349,012 A * 9/1982 Schildknecht ..... 126/586
4,763,115 A * 8/1988 Cota ..... 340/628
4,874,921 A * 10/1989 Gerbig, Jr. ..... B60H 1/00264 219/202
4,965,432 A * 10/1990 Harris ..... B60H 1/0025 219/203
5,025,130 A * 6/1991 Slone ..... B60H 1/00264 219/203
5,058,193 A * 10/1991 Appierto ..... 392/384
5,195,253 A * 3/1993 Poumey ..... A45D 20/04 34/97
5,394,620 A * 3/1995 Chimera ..... A45D 20/30 34/97
5,463,203 A * 10/1995 Moore ..... H05B 3/32 219/202
5,507,103 A * 4/1996 Merritt ..... A45D 20/10 34/97
5,781,695 A * 7/1998 Summers ..... B60H 1/00264 219/202
5,787,228 A * 7/1998 Fiely et al. ..... 392/383
(Continued)

*Primary Examiner* — Avinash Savani
*Assistant Examiner* — Deepak Deean
(74) *Attorney, Agent, or Firm* — Hahn Loeser & Parks, LLP

(57) ABSTRACT

A portable battery operated heater powered by a battery includes a housing having an air inlet formed at a rear wall and an air outlet formed at a front wall, the housing further comprising an interiorly concave portion extending from the rear wall to the front wall, the interiorly concave portion directing a flow of air from the air inlet to the air outlet; a fan electrically connectable to the battery, the fan being disposed within the housing for creating the flow of air; and a heating element electrically connectable to the battery, the heating element being interposed between the air inlet and the air outlet in such manner that the flow of air passes over the heating element and is heated thereby.

4 Claims, 4 Drawing Sheets

(56) References Cited

U.S. PATENT DOCUMENTS

| | | | | | |
|---|---|---|---|---|---|
| 5,787,601 | A * | 8/1998 | Stelly | A45D 20/44 | 34/101 |
| 5,907,232 | A * | 5/1999 | Wakefield | 320/130 | |
| 6,059,195 | A * | 5/2000 | Adams | F24H 9/2035 | 236/20 R |
| 6,134,902 | A * | 10/2000 | Curry | F24F 1/022 | 62/235.1 |
| 6,141,495 | A * | 10/2000 | Roth | 392/363 | |
| 6,317,998 | B1 * | 11/2001 | Benevelli | 34/97 | |
| 6,381,407 | B2 * | 4/2002 | Choi | 392/376 | |
| 6,480,672 | B1 * | 11/2002 | Rosenzweig | F24H 3/0417 | 392/365 |
| 6,624,397 | B2 * | 9/2003 | Tateishi | 219/508 | |
| 6,732,449 | B2 * | 5/2004 | Evanyk | A45D 20/12 | 34/96 |

* cited by examiner

PORTABLE BATTERY OPERATED HEATER

BACKGROUND OF THE INVENTION

Field of the Invention

The present invention relates to portable heaters and more particularly pertains to a new portable battery operated heater for providing a small amount of emergency heat.

Description of the Prior Art

The use of portable heaters is known in the prior art. More specifically, portable heaters heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable heaters include U.S. Pat. No. 5,259,062; U.S. Pat. No. 5,121,739; U.S. Pat. Des. 358,873; U.S. Pat. Des. 312,683; U.S. Pat. No. 4,737,616; and U.S. Pat. No. 5,278,936.

While these devices fulfill their respective, particular objectives and requirements, the aforementioned patents do not disclose a new portable battery operated heater. The heater of the invention includes a housing having an air inlet, an air outlet and an interiorly concave contoured wall extending from a rear wall to a front wall, the interiorly concave contoured wall being formed to direct a flow of air from the air inlet to the air outlet. A fan electrically connectable to a rechargeable battery or an alternate dc power source is disposed within the housing for creating the flow of air through the air inlet and out the air outlet. A heating element is electrically connectable to the battery and is interposed between the air inlet and the air outlet in such manner that the flow of air passes over the heating element and is heated thereby. A thermostatic control for controlling the operation of the fan and the heating element is connectable to the battery or alternate dc power source by means of a switch which additionally is operable to connect the fan to the battery or alternate dc power source.

In these respects, the portable battery operated heater according to the present invention substantially departs from the conventional concepts and designs of the prior art, and in so doing provides an apparatus primarily developed for the purpose of providing a small amount of emergency heat.

SUMMARY OF THE INVENTION

In accordance with the present invention, a portable battery operated heater powered by a battery includes a housing having an air inlet formed at a rear wall and an air outlet formed at a front wall, the housing further comprising an interiorly concave portion extending from the rear wall to the front wall, the interiorly concave portion directing a flow of air from the air inlet to the air outlet; a fan electrically connectable to the battery, the fan being disposed within the housing for creating the flow of air; and a heating element electrically connectable to the battery, the heating element being interposed between the air inlet and the air outlet in such manner that the flow of air passes over the heating element and is heated thereby.

In accordance with an alternate embodiment of the present invention, a portable battery operated heater powered by a battery includes a housing having an air inlet, an air outlet and an interiorly concave portion extending from a rear wall to a front wall, the interiorly concave portion formed to direct a flow of air from the air inlet to the air outlet; a fan electrically connectable to the battery, the fan being disposed within the housing for creating the flow of air through the air inlet and out the air outlet; a heating element electrically connectable to the battery, the heating element being interposed between the air inlet and the air outlet in such manner that the flow of air passes over the heating element and is heated thereby; a thermostatic control for controlling the operation of the fan and the heating element; a switch operable to alternatively electrically connect the thermostatic control to the battery and electrically connect the fan to the battery; a means for electrically connecting a battery charger to the battery; and a normally closed tip over switch operable to disconnect the battery from the switch.

These and other features, aspects and advantages of the present invention will become better understood with reference to the following drawings, description and claims.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
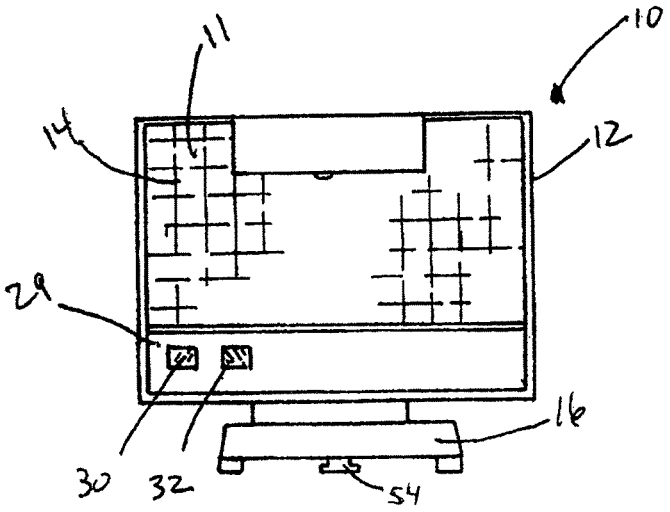
FIG. 1 is a front elevational view of a portable battery operated heater according to the present invention.

With reference now to the drawings, and in particular to FIGS. 1 through 6 thereof, a new portable battery operated heater embodying the principles and concepts of the present invention and generally designated by the reference numeral 10 will be described.

Figure 5:
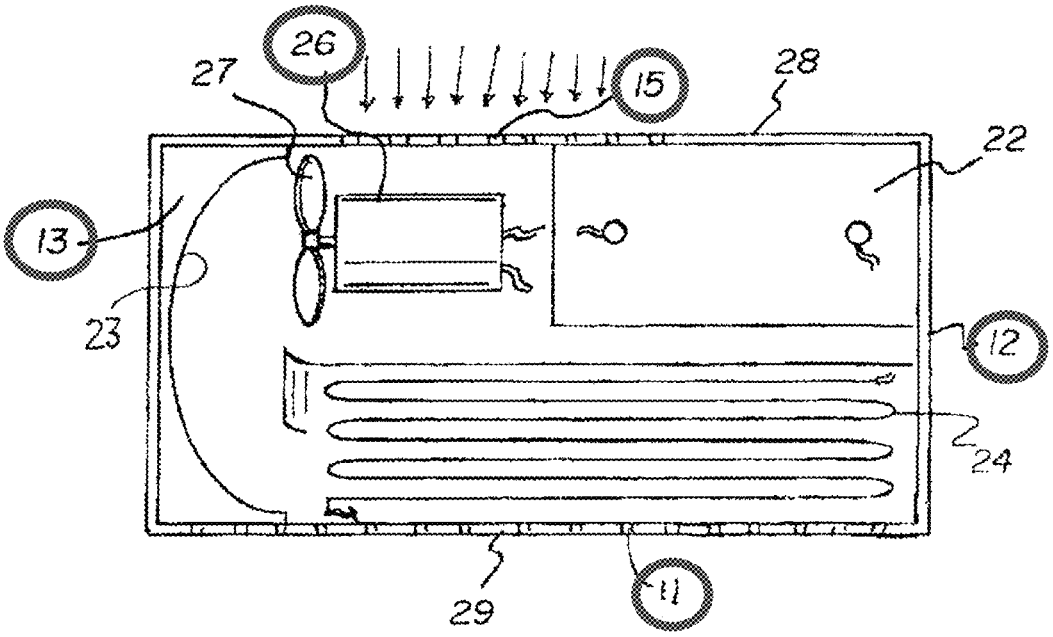
FIG. 5 is a cross sectional view of the present invention.

More specifically, it will be noted that the portable battery operated heater 10 comprises a housing 12 including an air inlet 15, an air outlet 11, and an interiorly concave contoured wall 13 which extends from a rear wall 28 to a front wall 29 (FIG. 5). A fan 26 is disposed within the housing 12 for creating the flow of air through the air inlet 15 and out the air outlet 11. The interiorly concave contoured wall 13 is disposed within the housing 12 and extends from the rear wall 28 to the front wall 29. The interiorly concave contoured wall 13 has an inwardly curved surface 23 in the direction of the fan 26, and the interiorly concave contoured wall 13 directs the flow of air along the inwardly curved surface 13 from the air inlet 15 to the air outlet 11. A heating element 24 is interposed between the air inlet 15 and the air outlet 11 in such manner that the flow of air passes over the heating element 24 and is heated thereby.

With reference to FIG. 1, the housing 12 is shown including an air outlet 11 including an opening covered by a metal grill 14. A power indicator LED 30 and an overheated condition LED 32, whose operation will be further described hereinbelow, are shown disposed on the front wall 29. The housing is further shown attached to a base 16 to which is mounted a tilt switch 54.

Figure 2:
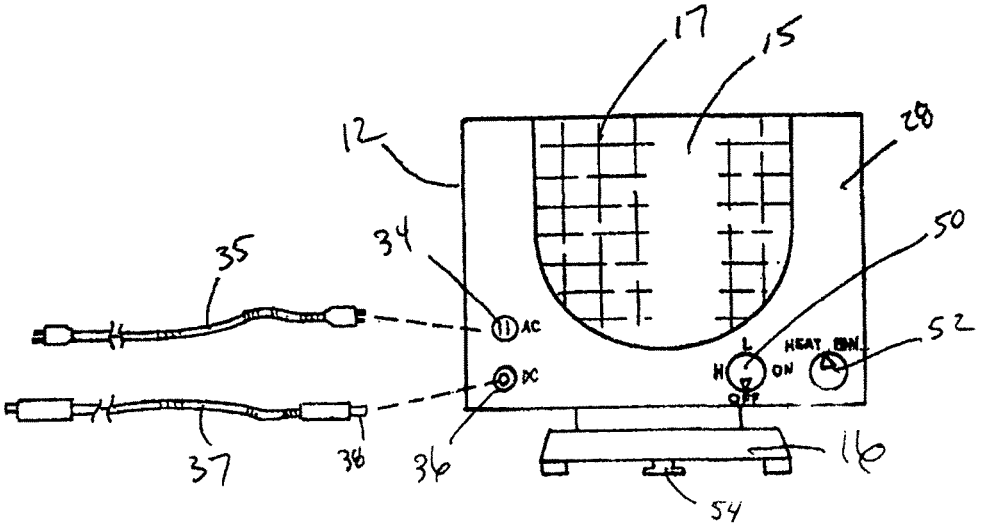
FIG. 2 is a read elevational view thereof.
Figure 6:
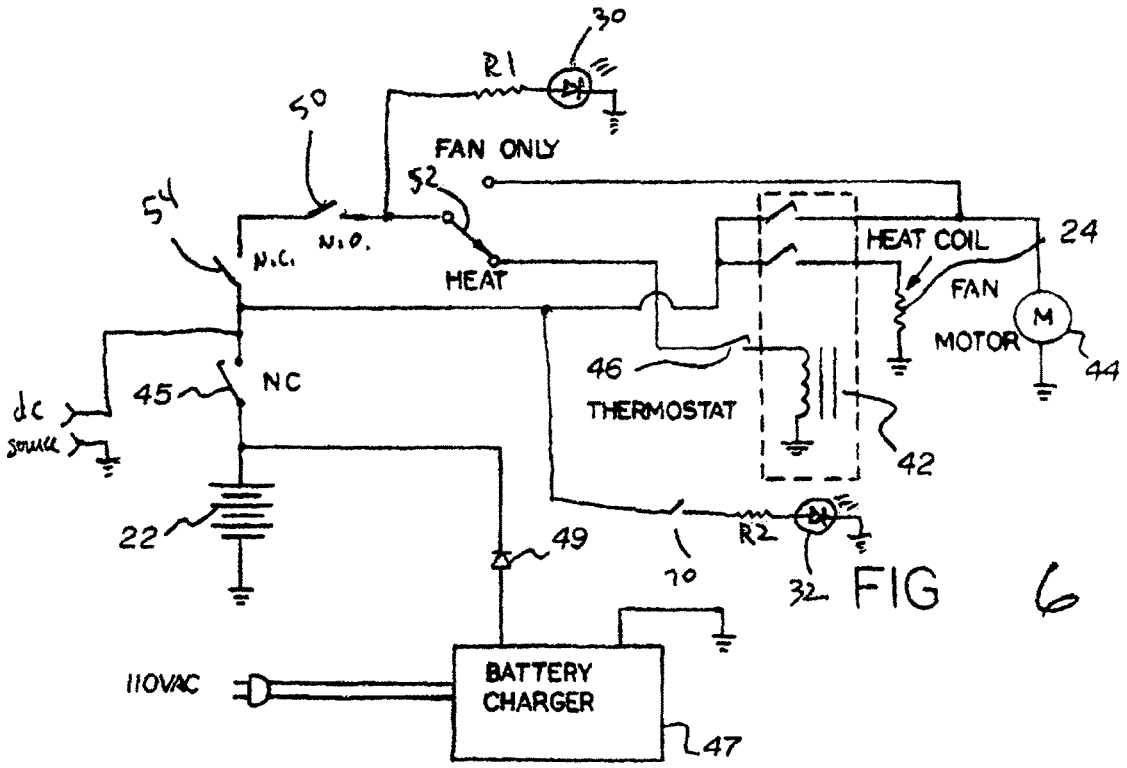
FIG. 6 is a schematic diagram of the electric circuit of the present invention.

With reference to FIG. 2, the rear of the housing 12 is shown including air inlet 15 including an opening covered by a metal grill 17. An ac jack 34 and dc jack 36 are disposed on the rear wall 28 for connection to an ac power source through ac connector 35 and to a dc power source through dc connector 37 respectively, the ac connection for supplying power to a battery charger 47 (FIG. 6). An integrated power/thermostatic switch 50 and selector switch 52 are shown disposed on the rear wall 28 and will be further described with reference to FIG. 6.

Figure 3:
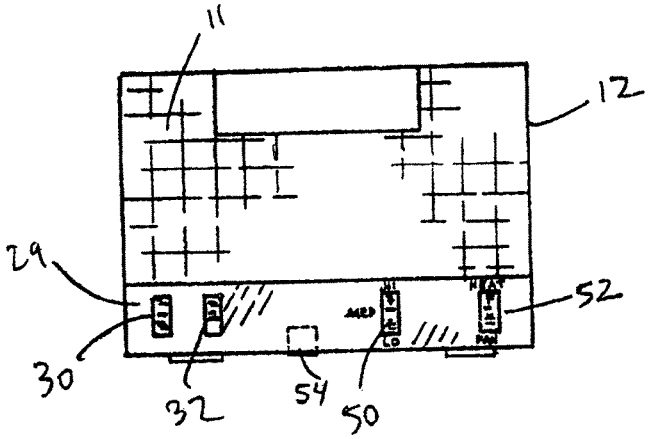
FIG. 3 is a front elevational view of an alternative embodiment of the present invention.
Figure 4:
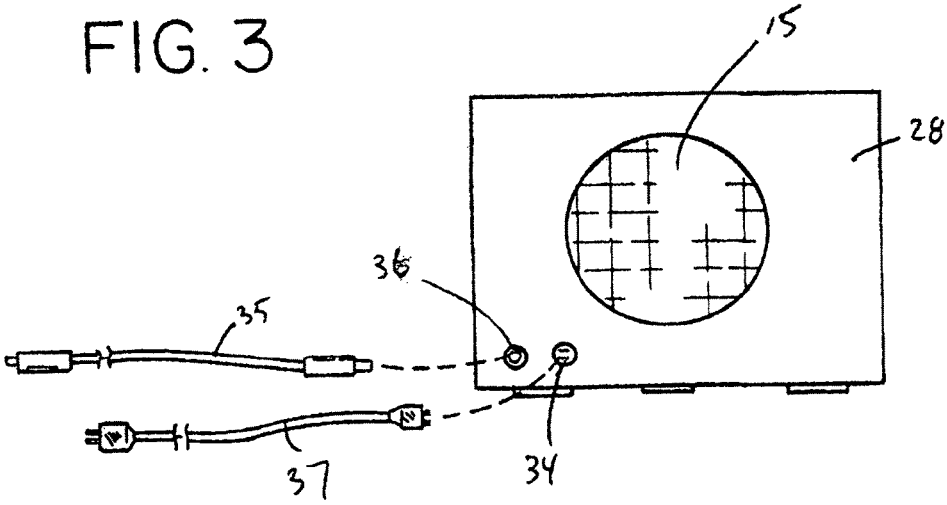
FIG. 4 is a rear elevational view thereof.

An alternative embodiment of the present invention is shown in FIGS. 3 and 4. This embodiment is identical to the embodiment shown in FIGS. 1 and 2 in all respects except that a base is not provided. Rather than being mounted to a base, the tilt switch 54 is mounted to a bottom portion of the housing 12.

Operation of the portable battery operated heater 10 will now be described with reference to FIGS. 5 and 6 which show a cross sectional view of the heater 10 and a schematic of the control circuit respectively. A rechargeable battery 22 is operably coupled to the heating element 24 and to the fan 26 through a series of switches 45, 54, 50 and 52. Power switch 50 is operably coupled to thermostat 46 and is operable to close the circuit between the rechargeable battery 22 and the heating element 24 and the fan 26. When power switch 50 is closed and selector switch 52 is set to the "HEAT" position, relay 42 is energized if the ambient temperature is lower than the temperature selected by thermostat 46 and power is delivered to the heating element 24 and to the fan 26.

The fan 26 includes a fan motor 44 and a fan blade 27 disposed within the housing 12. The fan 26 is disposed adjacent the air inlet 15. The fan is oriented in such manner that the fan 26 draws air through air inlet 15 and directs the drawn air along the interiorly concave contoured wall 13, passing over heating element 24, which preferably includes a coiled resistive element, and exiting the housing 12 through the air outlet 11.

The rechargeable battery 22 is shown disposed within the housing 12. The battery 22 is of a type able to supply a high current and having a good energy storage to weight ratio for portability. A battery charger 47 is operably connected to the battery 22 through a blocking diode 49 and is powered by an ac power source through ac jack 34.

The heater 10 is optionally powered by an external dc source connectable to the control circuit through dc jack 36. The dc jack 36 includes a normally closed switch 45 which is opened upon insertion of plug 38 to disconnect the battery 22 from the control circuit.

With particular reference to FIG. 6, a normally closed tip over switch 54 is shown. The tip over switch 54 is provided to ensure that the fan motor 44 and heating element 24 are not connectable to the battery 22 in the event that the housing is not upright.

A high temperature sense switch 70, which is preferably a bi-metallic switch, is shown coupled to the battery 22 and is operable to close upon sensing a high temperature. The closing of switch 70 in turn energizes overheated condition LED 32.

In use, a desired temperature is selected by means of power switch/thermostat 50/46. If desired, the fan 26 can be operated on it's own to provide a flow of ambient air by means of selector switch 52. To provide a small amount of emergency heat, the selector switch 52 is moved to the heat position and if the ambient air temperature is lower than the temperature selected, the fan motor 44 and heating element 24 are energized by means of relay 42 and a flow of air is generated, the air entering the housing 12 through the air inlet 15, being directed by the interiorly concave contoured wall 13, passing over heating element 24 and exiting the housing 12 through the air outlet 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A portable battery operated heater powered by a battery comprising:

a housing having an air inlet formed in a rear wall and covered by a back metal grill, and an air outlet formed in a front wall and covered by a front metal grill, wherein the battery is disposed within the housing;

a fan electrically connected to the battery, the fan being disposed within the housing for creating a flow of air;

an interiorly concave portion disposed within the housing and extending from the rear wall to the front wall, the interiorly concave portion having an inwardly curved surface in the direction of the fan, the interiorly concave portion directing the flow of air along the inwardly curved surface from the air inlet to the air outlet;

a resistive heating element electrically connected to the battery, the heating element being interposed between the air inlet and the air outlet in such manner that the flow of air passes over the heating element and is heated thereby;

a thermostatic control for controlling the operation of the fan and the heating element;

a normally closed tip over switch operable to disconnect the battery from the switch; and a high temperature bi-metallic sense switch electrically connected to the battery and operable to close upon sensing a high temperature and to recognize an overheated condition light emitting diode coupled thereto.

2. The portable battery operated heater of claim 1, further comprising a blocking diode means for electrically connecting a battery charger to the battery.

3. The portable battery operated heater of claim 1, further comprising a switch operable to alternatively electrically connect the thermostat control to the battery and electrically connect the fan to the battery.

4. A portable battery operated heater powered by a battery comprising:

a housing having an air inlet formed in a rear wall and covered by a back metal grill, and an air outlet formed in a front wall and covered by a front metal grill, wherein the battery is disposed within the housing;

a fan electrically connected to the battery, the fan being disposed within the housing;

an interiorly concave portion disposed within the housing and extending from the rear wall to the front wall, the interiorly concave portion having an inwardly curved surface in the direction of the fan, the interiorly concave portion directing the flow of air along the inwardly curved surface from the air inlet to the air outlet;

a resistive heating element electrically connected to the battery, the heating element being interposed between the air inlet and the air outlet in such manner that the flow of air passes over the heating element and is heated thereby;

a thermostatic control for controlling the operation of the fan and the heating element;

a switch operable to alternatively electrically connect the thermostatic control to the battery and electrically connect the fan to the battery;

a blocking diode for electrically connecting a battery charger to the battery;

a normally closed tip over switch operable to disconnect the battery from the switch; and a high temperature bi-metallic sense switch electrically connected to the battery and operable to close upon sensing a high temperature and to energize an over-heated condition light emitting diode coupled thereto.

* * * * *